United States Patent [19]

Marsh et al.

[11] Patent Number: 5,065,149

[45] Date of Patent: Nov. 12, 1991

[54] SCANNED DOCUMENT IMAGE RESOLUTION ENHANCEMENT

[75] Inventors: Robert M. Marsh, Berkeley; Timothy J. Hill; Mark Potts, both of San Francisco, all of Calif.

[73] Assignee: Document Technologies, Inc., Mountain View, Calif.

[21] Appl. No.: 434,992

[22] Filed: Nov. 9, 1989

[51] Int. Cl.[5] ..... G09G 3/00

[52] U.S. Cl. ..... 340/793; 340/703; 340/705; 382/56

[58] Field of Search ..... 382/47, 56; 358/77, 358/429, 104; 340/750, 720, 723, 793, 703, 728; 364/522

[56] References Cited

U.S. PATENT DOCUMENTS

| | | | |
|---|---|---|---|
| 4,210,936 | 7/1980 | Cinque et al. | 358/283 |
| 4,229,768 | 10/1980 | Kurahayashi et al. | 358/261 |
| 4,280,144 | 7/1981 | Bacon | 358/280 |
| 4,408,197 | 10/1983 | Komatsu et al. | 340/750 X |
| 4,447,809 | 5/1984 | Kodama et al. | 340/750 X |
| 4,481,509 | 11/1984 | Sasaki et al. | 340/728 |
| 4,484,188 | 11/1984 | Ott | 340/728 |
| 4,532,503 | 7/1985 | Pennebaker | 340/728 |
| 4,532,651 | 7/1985 | Pennebaker et al. | 382/54 |
| 4,546,385 | 10/1985 | Anastassiou | 358/133 |
| 4,556,878 | 12/1985 | Dwire et al. | 340/724 |
| 4,558,370 | 12/1985 | Mitchell et al. | 358/260 |
| 4,646,356 | 2/1987 | Anderson et al. | 382/56 |
| 4,667,247 | 5/1987 | Karow | 358/280 |
| 4,707,745 | 11/1987 | Sakano | 358/283 |
| 4,723,298 | 2/1988 | Schiller | 382/56 |
| 4,742,553 | 5/1988 | Irwin | 382/47 |
| 4,835,527 | 5/1989 | Hersh | 340/750 X |

OTHER PUBLICATIONS

R. Jadrnicek, "*IBM's Professional Graphics System,*" *BYTER Magazine, Nov. 1985, pp. 355–359.*

*Primary Examiner*—Ulysses Weldon

*Attorney, Agent, or Firm*—Schneck & McHugh

[57] ABSTRACT

Method and apparatus for providing high resolution images for static display of document pages that are scanned in through a document scanner at high resolution, with reduced bandwidth requirements. In one embodiment, groups of four scanned image pixel values, each one bit in length, are reduced to a single two-bit pixel value that determines a pixel value for a display image pixel; and selected displayed image pixel values are periodically varied between the original displayed image pixel value and an alternative pixel value to restore the perception of high resolution available in the scanned image.

13 Claims, 4 Drawing Sheets

SCANNED DOCUMENT IMAGE RESOLUTION ENHANCEMENT

TECHNICAL FIELD

This invention relates to processing of document images for display and for enhancement of resolution of the images displayed.

BACKGROUND OF THE INVENTION

Document images can be scanned, and electronic images thereof can be generated and stored, at resolutions such as 2400 dots per inch that are far beyond what can be displayed on monochrome cathode ray tube ("CRT") devices that are available today at reasonable cost. Presently, scanned document image displays provide screen images with resolutions of the order of one hundred dots per inch or less.

Cinque et al., in U.S. Pat. No. 4,210,936, disclose method and apparatus to reproduce a half-tone image by dividing the image into a number of pixels in which one image data are compressed; the image reproduction matrix utilizes less gray scale data than is generated from the original pixel matrix. In one embodiment, four information bits of gray scale data are combined to yield one information bit in the displayed image. Apparently, no technique is disclosed for enhancing the actual or perceived resolution of the compressed gray scale data through modification of the image display.

U.S. Pat. No. 4,229,768, issued to Kurahayashi et al. is one of the earliest patents to disclose use of a protocol that later became the CCITT X.25 standard. A high data compression ratio is achieved without excessive deterioration in image quality by use of run-length encoding for data compression and an inverse process for data expansion, using correlation of image signals on adjacent scan lines of the original image.

A coarse scan and fine print algorithm is disclosed by Bacon in U.S. Pat. No. 4,280,144. The original coarsely scanned pixel element is divided into four adjacent sub-pixels of approximately equal area, and pixel information for the original pixel and for four nearest neighbor pixels is used to construct modified pixel values for each of the sub-pixel regions contained in the original pixel. Each reconstructed pixel value thus relies upon data from three adjacent scan lines.

Pennebaker discloses combination of pixel value data of two adjacent pixels on a scan line in order to construct composite pixels with improved image quality in U.S. Pat. No. 4,532,503. Each composite pixel value is defined by two bits, with the most significant bit being defined only by the original pixel value and the least significant bit of the composite pixel value being determined by the two neighboring pixel values. The composite pixel value contains information from only a single scan line.

In U.S. Pat. No. 4,532,651, Pennebaker et al. disclose a gray scale filter for image data by combining pixel values from two adjacent pixels on a single scan line of the original image. The most significant bit of a pixel value is used to determine gray scale transition in a reconstructed image.

An object of the invention is to provide scanned document images at a perceived resolution of up to 2400 dots per inch using a raster scan CRT display.

Another object of the invention is to provide means for electronic generation of document images that provide a reasonable gray scale for static image display without requiring excessive band width.

SUMMARY OF THE INVENTION

These objects are met by method and apparatus that forms groups of information bits or pixel values from each of four adjacent picture elements or pixels on two adjacent scan lines of a scanned document for document display. This group of four pixel values is converted to a single two-bit sequence that prescribes a transformed pixel value for a single pixel of a display image. The system displays the transformed pixel values, using time averaging of pixel values for pairs of adjacent pixels to produce an image with a perceived increase in resolution on the screen. The original scanned image resolution of, say, 400 dots per inch, wherein four scanned image pixels correspond to one display image pixel, is thus first reduced, by a factor of two or more, to a lower resolution signal for subsequent processing. This reduces the bandwidth requirements for processing by a factor of two or more. When the processed image is displayed, time averaging of pixel values for pairs of pixels on adjacent field lines increases the perceived resolution so that the resolution lost during scanning and subsequent processing appears to be restored.

The apparatus includes a timing generator module to generate and issue a sequence of timing signals for synchronization. A memory module receives and stores image data received from a document scanner or other source and provides such data as output signals. A look-up table and serializer module receives data in groups of four bits from the memory array and issues a two-bit sequence, representing each such bit group, which defines a transformed pixel value for document image formation. A raster scan CRT module receives the output signal from the look-up table and serializer module and forms and displays a static document image on a screen by periodically varying selected transformed pixel values.

The look-up table and serializer module receives data from the memory, arranges the data into groups of four information bits from two adjacent document scan lines of data, and counts the number of bits of a selected bit polarity in each such group. The look-up table and serializer module then issues a two-bit sequence that prescribes a three-level or a four-level transformed pixel value for each pixel on a display screen in a serial output stream for use by the CRT module.

The CRT module receives the output signals from the look-up table and serializer module and forms a raster scanned, interlaced display on a video screen, utilizing two mutually exclusive fields of pixels that together form an image frame on the screen. The transformed pixel values are periodically varied to improve the perceived resolution of the image displayed on the screen.

BEST MODE FOR CARRYING OUT THE INVENTION

Figure 1:
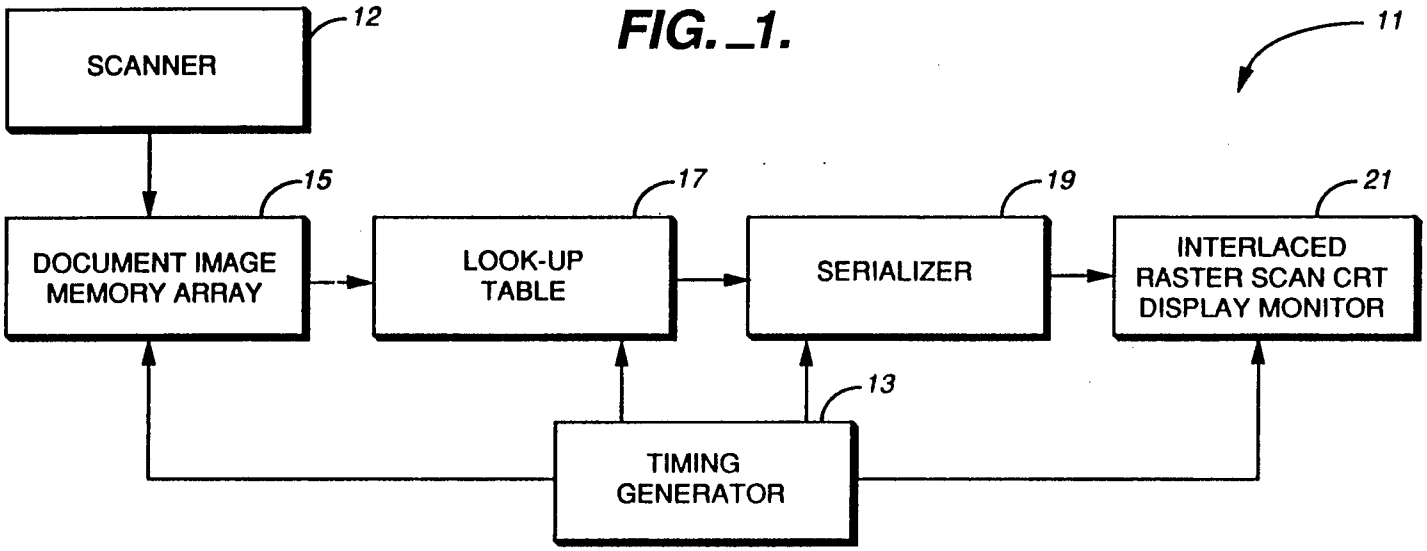
FIG. 1 is a block diagram of the major components of apparatus according to the invention.

With reference to FIG. 1, the apparatus 11 of the invention includes a timing generator 13 to generate synchronization signals that are used by the other modules. A document image memory array ("DIMA") 15 receives signals representing a document image from a source 12 of scanned image data that is not a part of the invention. A look-up table ("LUT") module 17 receives the information stored in the DIMA 15 in parallel streams, arranges the data in groups of four information bits from two adjacent scan lines, and determines from each group of four information bits an ordered pair of bits (b0,b1) that will determine the pixel value for a display image pixel. A serializer module 19 converts parallel streams of data to one or two serial streams of data that issue at a much higher rate. A raster scan CRT module 21 receives the serializer output data streams includes a display screen for high resolution display of the document image formed from the data.

Figure 2:
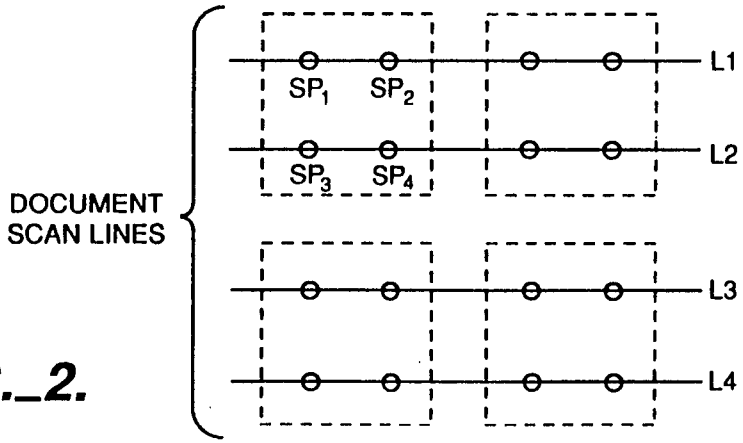
FIG. 2 is a plan view illustrating groups of four scanned image pixels whose pixel values together determine the pixel value for one pixel on a document image display screen.

Initially, a high resolution scanner or other source 12 of scanned image data (not part of the invention) provides a plurality $N_1$ of horizontal scan lines, with each scan line having a plurality $N_2$ of scanner image pixels that represent the image to be reproduced. This scanned image should be distinguished from the display image that will be displayed by the CRT module. In one 400 dot per inch ("dpi") configuration of interest, the scanner produces $N_1=4400$ scan lines, each containing approximately $N_2=3400$ scanned image pixels. The scanner loads scanned image pixel value data into the DIMA 15. For example, consider four scanned image pixel values $spv_1$, $spv_2$, $spv_3$ and $spv_4$ for four adjacent scanned image pixels on two adjacent scan lines $L_1$ and $L_2$, as indicated in FIG. 2. These may correspond to and contribute to a single pixel position on the viewing screen that is part of the CRT module 21. The four corresponding pixel values $spv_1$, $spv_2$, $spv_3$ and $spv_4$ will be stored at suitable locations in the DIMA 15 and will be called out as a group of four information bits, from two or more output signal lines from the DIMA 15. More generally, a set of J adjacent pixels, such as a rectangular set of $M \times N$ scanned image pixels on M adjacent scan lines such as L1, L2, . . . , LM, may provide a group of J information bits or pixel values for subsequent use in image formation. This set of J information bits or pixel values may be fed to the LUT module 17 to determine a K-bit pixel value for an image pixel displayed on a screen of the CRT module 21, with K smaller than J, as discussed below. For example, with 2400 dpi resolution of the scanned image data source 12 in FIG. 1, pixel values for $J=24$ adjacent scanned image pixels, in a block or a $4 \times 6$ block, could be used to determine a single pixel value on the CRT module viewing screen.

In a 200 dpi configuration, the numbers $N_1$ and $N_2$ would be $N_1=2200$ and $N_2=1700$. The invention is not limited to 200 dpi or 400 dpi and may produce any resolution up to 2400 dpi, or even higher. However, for purposes of illustration of the invention, an example is discussed herein that begins with a 400 dpi scanned image resolution and utilizes 200 pixels per inch display image resolution on a CRT viewing screen to produce a displayed image that appears to be equivalent to the original scanned image with 400 dpi resolution.

The document image data are issued from the DIMA 15 at a rate such as $1.1 \times 10^7$ 64-bit words per second in 64 parallel streams, with 32 of these streams carrying bits with pixel value information from each of a pair of adjacent scan lines from the scanned image. For example, pixel values from scan lines L1, L3, L5, . . . in FIG. 2 will be sent to one half of the memory, and pixel values from scan lines L2, L4, L6, . . . will be sent to the other half of the memory. In FIG. 2, the two scan lines L1 and L2 will contribute to, say, a line in the even field in a display frame for the displayed document image, and the two lines L3 and L4 will contribute to an adjacent line in the odd field of a display frame.

The LUT module 17 in FIG. 1 receives the data input signals from the DIMA 15 in groups of four information bits (more generally, J information bits). The module 17 then makes a determination of the two-bit ordered pair (b0,b1) (more generally, an ordered set of K bits with K smaller than J) to be issued for a pixel value for each display image pixel in each of the two fields that make up the display image. The serializer module 19 reformats the ordered pairs or sets of bits and issues the ordered pairs or sets as two (more generally, K) serial output signal streams, with the bits b0 carried on one output line of the module 19 and the bits b1 carried on the other output line, at an output rate of about $1.8 \times 10^8$ two-bit words per second. The two (more generally, K) serializer output signal streams are received by a CRT module 21 and are used together to prescribe a transformed pixel value for one of the two interlaced sets of lines of pixels that form the even and odd fields of a frame displayed on the screen. The transformed pixel values are periodically varied in displaying an image.

Figure 3:
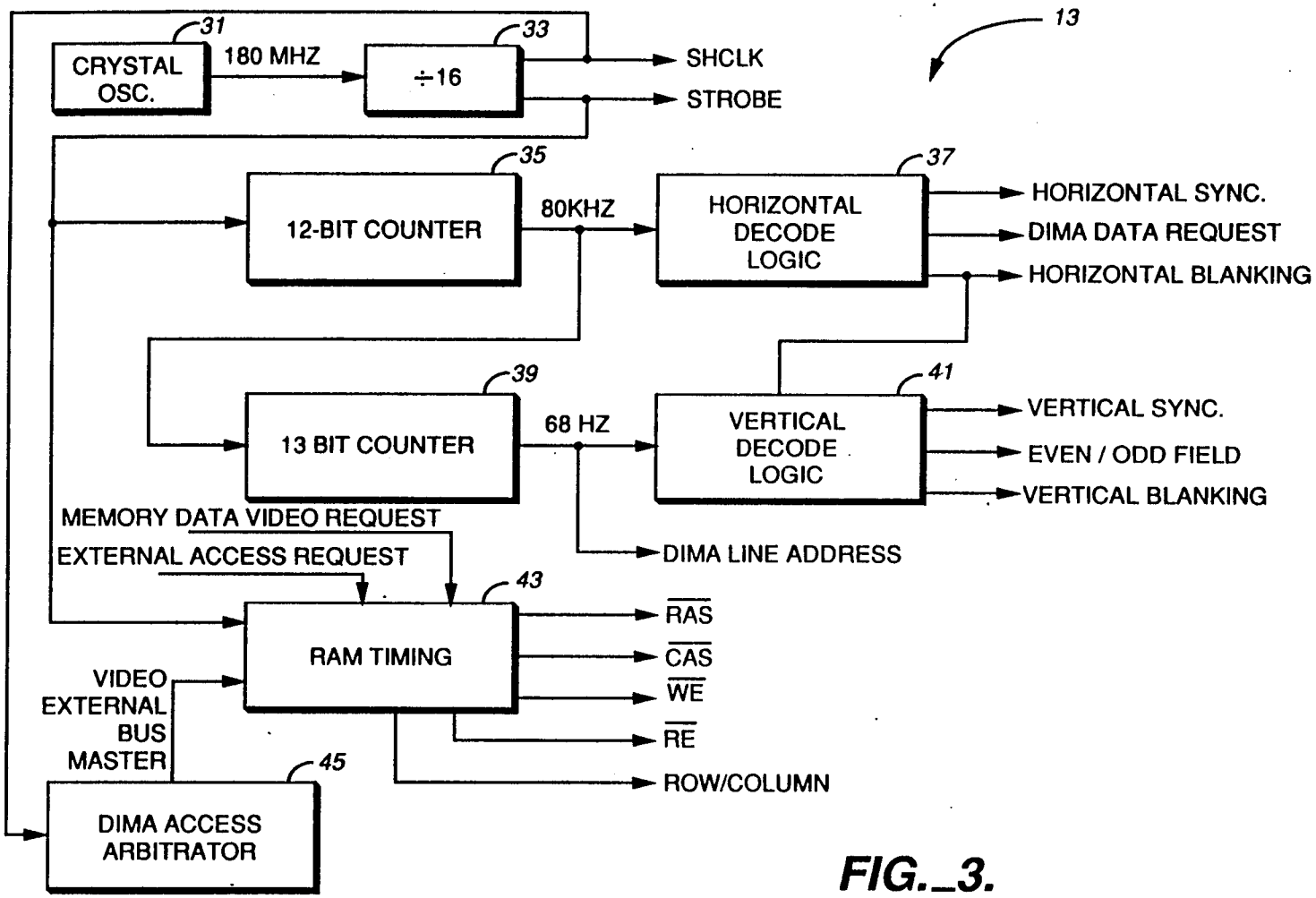
FIG. 3 is a schematic view of a timing generator module shown in FIG. 1 according to the invention.

The timing generator 13, shown in FIG. 3 in one embodiment, includes a crystal or other oscillator 31 that produces an undulatory output signal of frequency approximately 180 MHz and three frequency divide modules 33, 35 and 39. The timing generator 13 also includes two decode logic modules 37 and 41, a RAM timing module 43, and a DIMA access arbitrator module 45. A "divide-by-16" (more generally, divide-by-P, where P is a positive integer) frequency divider module 33, such as a four-bit counter, receives the oscillator output signal and issues two undulatory output signals of frequency 11.25 MHz with different phases. A 12-bit counter 35 receives the output signal from the frequency divider module 33 and issues an undulatory output signal of frequency approximately 80 kHz (11.25 MHz $\div 140$). A horizontal decode logic module 37 receives the output signal from the counter 35 and produces a horizontal synchronization pulse train, a DIMA data request pulse train, and a horizontal blanking pulse train, all of frequency approximately 80 kHz but with different pulse widths. A Q-bit counter 39, with Q greater than 10 receives the output signal from the counter 35 and produces an undulatory output signal of frequency approximately 68 Hz. A vertical decode logic module 41 receives the Q-bit counter output signal and produces a vertical synchronization pulse train, an even/odd field choice pulse train, and a vertical blanking pulse train, all of frequency approximately 68 Hz but with different pulse widths. A random access memory ("RAM") timing module 43 receives the output signal from the frequency divider module 33 and receives an external access request signal and a memory data request signal and produces up to five RAM timing module output signals. The initial undulatory signal frequency of 180 MHz may be reduced to a frequency as low as 110 MHz, and possibly lower, without affecting operation of the apparatus 11. An output signal from the frequency divider module 33 also serves as the data load strobe input signal STROBE for the serializer module 19; and the output signal from the counter 39 also serves as the line address signal for the DIMA 15. The output signal from the frequency divider module 33 also provides a clock signal SHCLK, also of frequency 11.25 MHz but with a different phase, that shifts data, 16 bits at a time, from the DIMA 15 to the LUT module 17. A DIMA access arbitrator module 45 arbitrates simultaneous requests for access to the DIMA for different uses of the data therein.

The five RAM timing module output signals include row and column refresh request signals, denoted $\overline{RAS}$ and $\overline{CAS}$, for the DIMA 15, if a dynamic or volatile RAM is used for memory (not required if a non-volatile memory is used). These output signals also include write enable and read enable signals, denoted $\overline{WE}$ and $\overline{OE}$, for the DIMA 15. The fifth output signal is a row/column address prescription signal, denoted ROW/$\overline{COLUMN}$, that indicates the row and column location in the DIMA 15 of the next scanned image pixel value to be read from that location ($\overline{OE}$), or to be over-written by a new value ($\overline{WE}$).

A DIMA that is large enough to store scanned image data from an $8.5\times11$ inch page at 400 dots per inch resolution requires a memory capacity of at least $14.96\times10^6$ bits or at least $1.87\times10^6$ 8-bit bytes of information. The information bits are received from a document scanner 12, which is not a part of the invention but is shown in FIG. 1 for completeness. These information bits arrive in a serial stream or in parallel streams of data at data rates that can be supported by the document scanner 12. The data received by the DIMA 15 from the document scanner 12 are stored as a collection of binary-encoded, one-bit pixel values, with each pixel value representing black or white on the original document. Blocks of such data, representing blocks of pixel values, are processed by the invention to produce a real time video signal that generates the document display on the raster scan CRT module 21.

Figure 4:
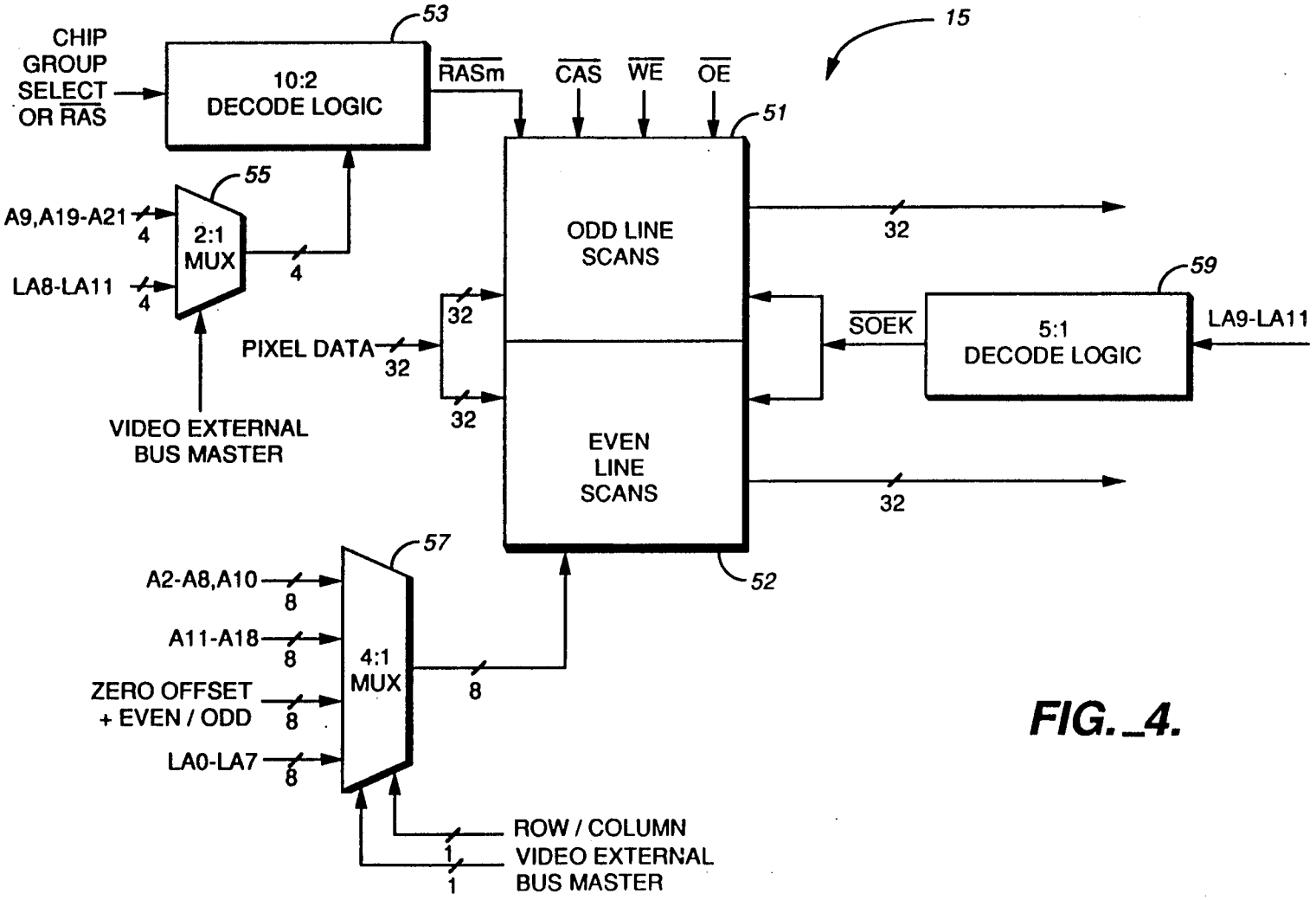
FIG. 4 is a schematic view of a document image memory array shown in FIG. 1 according to the invention, illustrating the formation of the two fields of pixel data.

FIG. 4 shows the DIMA 15 in one embodiment in more detail. The DIMA 15 includes two 320 kilobit$\times$32-bit memory arrays 51 and 52, one for each of two sets of scanned pixel data received from the document scanner 12. Each of the two memory arrays 51 and 52 may consist of five memory sub-arrays, each having a 64 kilobit$\times$32-bit memory, or the arrays may consist of a plurality of memory sub-arrays of a different size. A 10-to-2 (more generally, 2M-to-2 with M at least equal to 2) decode logic module 53 receives the row address RAS for the memory refresh command as an 18-bit address at one input terminal and determines which of five sub-arrays of memory chips in each of the memory arrays 51 and 52, and which row in that sub-array, the memory refresh command is to be applied to through issuance of an output signal RASm (m=0,1, . . . ,9). A 2-to-1 multiplexer ("MUX") 55 receives four bits A9 and A19–A21 of an external bus master address at one input terminal and receives four bits LA8–LA11 of a memory storage line address at a second input terminal, with the output of the MUX 55 being fed to a second input terminal of the decode logic module 53.

A 4-to-1 MUX 57 receives four different input signals, the first signal being eight bits A2–A8 and A10 of an external bus master address. The second input signal is another eight bits A11–A18 of the external bus master address. The third input signal is an even line-odd line designation bit, designating one of the two memory arrays 51 and 52, and a seven-bit zero offset signal that designates the horizontal starting position, measured from the left margin on the display screen, of the image display raster. The fourth input signal received by the MUX 57 is eight bits of the line address LA0–LA7. The MUX 57 also receives a one-bit ROW/$\overline{COLUMN}$ input control signal at a first input control terminal and a one-bit video external bus master signal at a second input control terminal, and issues a memory array address signal of eight bits that is received at an input terminal of the combined memory arrays 51 and 52. A 5-to-1 (more generally, M-to-1 with M at least equal to 2) decode logic module 59 receives the line address signal LA9–LA11 and a serial data output enable signal SOE and issues a set of five output signals $\overline{SOEk}$ (k=0,1,2,3,4) that is received by each of the memory arrays 51 and 52 and designates which of the five sub-arrays in a memory array a row of image data is to be read from and transmitted to the LUT 17 and serializer module 19. The combined memory arrays 51 and 52 also have three other control input terminals to receive signals. A second control input terminal receives the column prescription signals $\overline{CAS}$ for an array refresh command. A third input control terminal receives a write enable signal $\overline{WE}$ that allows the DIMA 15 to be written into, using document scanner or other data. A fourth input control terminal receives an output enable signal $\overline{OE}$ that allows data in the memory of the DIMA 15 to be read out. Each of the memory arrays 51 and 52 has a bi-directional 32-bit (more generally, $2^N$-bit with N at least equal to 2) data input terminal to receive scan line pixel data from the data source 12. Each of the memory arrays 51 and 52 also has a 32-bit (more generally, $2^N$-bit) data output terminal that allows data to be read from that array for formation of a CRT module display image.

The above description assumes that dynamic RAM is used for the memory arrays 51 and 52. If static RAM is used for the memory arrays 51 and 52, the $\overline{CAS}$ input signal for the combined memory arrays 51 and 52 may be eliminated and the RAS signal is replaced by another chip group select signal as an input to the 10-to-2 (more generally, 2M-to-2 with M at least equal to 2) decode logic module 53.

The stored data are read from the DIMA 15 for the image display one row at a time from one of the two RAM arrays 51 or 52 so that the row/column control input signal requires 8 bits to prescribe the row to be read from and one bit to prescribe the RAM array 51 or 52 to be used for that purpose, a total of 19 bits. The external data received by the two RAM arrays 51 and 52 are issued as 32-bit output signals and are received by the LUT module 17 for processing to form the pixel data for the even and odd fields of the display image. The two RAM arrays 51 and 52 together provide storage locations for approximately $16.8\times10^6$ bits, which is more than the approximately $15\times10^6$ bits required to store data for a single $8.5\times11$ inch page at a resolution of 400 dots per inch. If greater or lesser resolution is desired, or if the size of the page of the data differs from that for the normal page, a lesser or greater number of RAM storage locations may be provided. Provision of more than one document page in memory for subsequent retrieval and display will require additional memory.

The data input terminals for each of the memory arrays 51 and 52 in FIG. 4 are preferably bi-directional so that: (1) scanned image data may be written into memory by a document scanner 12 and (2) scanned image data stored in the memory arrays 51 and 52 may be read out and sent to a CPU (not shown) for monitoring or further processing.

Figure 5:
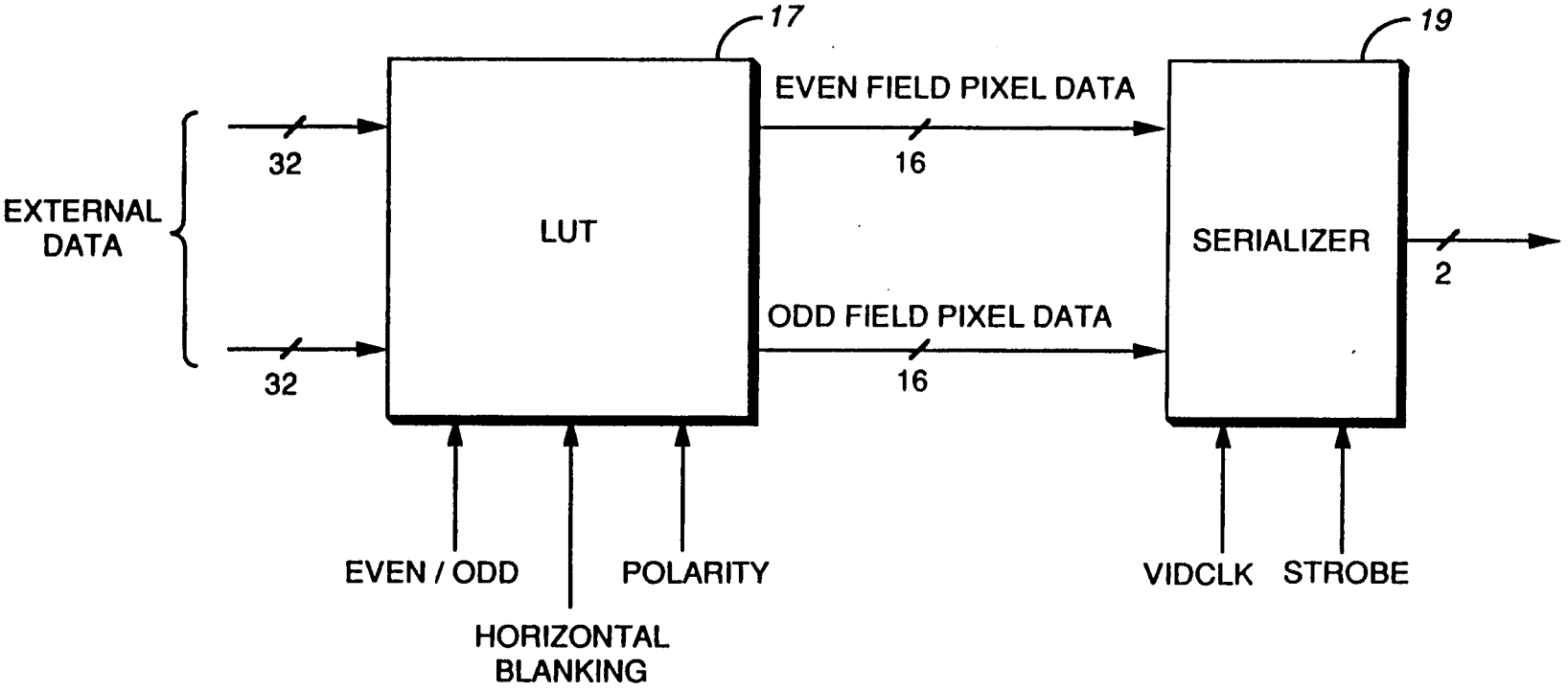
FIG. 5 is a schematic view of a look-up table module and the serializer module shown in FIG. 1 according to the invention.

FIG. 5 shows the relationship between the LUT module 17 and the serializer module 19. These two modules could be combined into a single LUT/serializer module for purposes of performing the tasks of converting and reformatting the pixel data for use in the CRT module 21. The LUT module 17 receives two parallel streams of external data, each of fixed width such as 32 bits, from the DIMA 15 as shown. A group of four bits (more generally, J bits) of the external data received is interrogated, the number of "on" bits having a chosen polarity, either 0 or 1, is counted and a look-up table is consulted to determine the ordered pair (b0,b1) of bits (or ordered set of K bits with K smaller than J) that will determine a pixel value of the document image to be displayed on the video screen of the CRT module 21.

Table I illustrates one embodiment of the input/output conversion table for the LUT module 17 that produces an ordered pair (b0, b1) of output bits from a group of four input bits. For the display polarity chosen, namely, either black characters on a white background or white characters on a black background, the LUT module 17 accepts a group of four bits from the DIMA 15, counts the number of "on" bits in the group, and issues an appropriate ordered pair (b0, b1) of bits in parallel at the two output terminals of the LUT module 17. The pixel whose pixel value is determined by (b1) may belong to an even field or to an odd field of the display image, as indicated. For example, if the black on white display polarity is chosen, a group that contains three "on" bits would be reformatted to produce an output signal of (b1,b0)=(on,off) and (b1,b0)=(off,off) for the even and odd fields, respectively. For a given choice of display polarity, the (b1,b0) output bits for counts 1 and 3 (number of "on" bits is 1 or 3) for the even field are not identical to the (b1,b0) output bits for counts 1 and 3, respectively, for the odd field.

This discrepancy is intentional and is utilized in forming time-averaged pixel values by periodically changing certain pixel values for pixels on adjacent lines produced by the CRT module 21, to achieve a finer perceived resolution. Time averaging is implemented by periodically varying a pixel value between an "on" state and either an "off" or "blanked" or zero state, which consists of all pixel value bits "off", or another predetermined alternative state.

TABLE I

LUT Input/Output Conversion Table.

| Display Polarity | Number Of Bits 'On' | Even/Odd Field | Binary Bits Output To CRT b1 | b0 |
|---|---|---|---|---|
| black on white | 0 | even | on | on |
| | 1 | even | on | on |
| | 2 | even | on | off |
| | 3 | even | on | off |
| | 4 | even | off | off |
| | 0 | odd | on | on |

TABLE I-continued

LUT Input/Output Conversion Table.

| Display Polarity | Number Of Bits 'On' | Even/Odd Field | Binary Bits Output To CRT b1 | b0 |
|---|---|---|---|---|
| | 1 | odd | on | off |
| | 2 | odd | on | off |
| | 3 | odd | off | off |
| | 4 | odd | off | off |
| white on black | 0 | even | off | off |
| | 1 | even | off | off |
| | 2 | even | on | off |
| | 3 | even | on | off |
| | 4 | even | on | on |
| | 0 | odd | off | off |
| | 1 | odd | on | off |
| | 2 | odd | on | off |
| | 3 | odd | on | on |
| | 4 | odd | on | on |
| video blanking | X | X | off | off |

(X: don't care)

The LUT module 17 receives two control signals, one control signal specifying an even or odd field line for each four-bit information group, and a second control signal specifying the chosen display polarity to be used for the counting process and for image display. The ordered pairs (b0,b1) of bits are issued as output signals in two groups, each of which may be parallel sets of lines up to 16 bits wide, representing converted pixel data for the even and odd fields of the display. These output signals are received by the serializer 19, and each of the two 16-bit-wide parallel streams of converted pixel data is reformatted and issued as a serial output stream at one of two output terminals of the serializer 19. The serializer 19 also receives two control input signals, one for the video clock signal VDCLK and another for the serializer data load strobe signal strobe that controls the output signal rate for the serializer 19. All control signals received by the LUT module 17 or the serializer 19 are generated by the timing signal module 13.

The number of bits b0 and b1 used here is not limited to two but may be any greater integer K as well, consistent with available space in the DIMA 15 and in the look-up table module 17. The scanned image pixel values received from the high resolution scanner 12 shown in FIG. 1 are binary, having only the values 0 and 1; and J of these scanned image pixel values may be used to create an ordered K-tuple (b0, b1, . . . , b(K-1)) of bits that determines a display pixel value and that allows use of up to $2^K$-2 intermediate gray values, plus black and white, for document display. This would allow a total of $2^K$ monochrome levels for each display pixel, and time averaging would produce up to $2^{K+1}$ monochrome levels for each display pixel value. Where J=2 bits per display pixel value are used, as here, the number of gray levels available is zero, one or two. In the embodiment shown in Table I, the number of gray levels actually used is one so that a pixel value may have three monochrome levels, namely white, mid-gray and black. Time averaging will produce at least two additional perceived monochrome levels, namely light gray and dark gray, for a total of five or more such levels. For purposes of display of a static document image on a video screen, it has been found that five monochrome levels, including three different gray levels, is adequate for most observers. If additional monochrome levels are required, Table I can be expanded to provide all four monochrome levels of pixel values, namely (b0,b1)=(o-n,on), (on,off), (off,on) and (off,off), before time averaging occurs. Additional output signal bits can be provided to produce an ordered K-tuple, as discussed above, which can provide up to $2^{K+1}$ perceived monochrome levels when used together with time averaging.

The LUT module 17 also implements horizontal and vertical blanking intervals for the display and the video display polarity functions used for conversion of the scanned pixel data. Because the LUT module 17 operates with parallel input and output signal streams at a much lower rate than does the video output signal received by the CRT module 21, the look-up table itself can be implemented using inexpensive, programmable read-only memory or programmable logic device components. The look-up table itself does not require use of the more expensive emitter-coupled logic devices that are used for signal processing by the CRT module 21.

The DIMA 15, the LUT module 17 and the serializer module 19 shown in FIG. 1 together serve as a transformation module that receives scanned image data from a source 12 and forms mutually exclusive sub-arrays of J scanned image pixel values corresponding to J adjacent pixels in the document scanned. The transformation module then counts the number of pixel values with the chosen polarity in each such scanned image group, consults a look-up table, and issues an ordered set of K bits that is determined by this count. The K-bit set determines a pixel value for the displayed image and is received by the CRT module 21.

We claim:

1. Apparatus for providing improved resolution of an image displayed on a screen, comprising:

transformation means, receiving a plurality of lines of image data from a source, each line including a sequence of pixel values, for forming mutually exclusive groups of J pixel values from said received image data for J adjacent image pixels, for counting the number of pixel values with a selected polarity in each group of J pixel values, and for issuing as output signals an ordered set of K bits that is determined by this count for each group of J pixel values, where each ordered set of K bits that is determined by this count for each group of J pixel values, where each ordered set of K bits determines a display pixel value for the displayed image, and where J and K are determined positive integers with K smaller than J; and display means for receiving the ordered sets of K bits from the transformation means, for determining an d displaying a pixel value on the screen for each such set of bits, and, where a display pixel value belongs to a selected subset of pixel values, for periodically varying such pixel value between the determined pixel value and a predetermined alternative pixel value.

2. Apparatus according to claim 1, wherein said display means displays said pixel values on said screen by forming first and second, interlaced and mutually exclusive fields of pixel values.

3. Apparatus according to claim 2, wherein said transformation means comprises:

memory means having storage locations for pixel values, for receiving and storing said image data from said source and for issuing the contents of these storage locations as memory output signals; and look-up table and serializer means, for receiving memory output signals from the memory means, for forming from said memory output signals said groups of J pixel values, for counting the number of pixel values of said selected polarity in each group of J pixel values, and, for each such group, for issuing in a serial output stream said ordered set of K bits that determines the display pixel value for a pixel of said displayed image.

4. Apparatus according to claim 3, wherein said look-up table and serializer means comprises:

a look-up table that has one or more scan groups of up to J data input terminals each and has one or more groups of up to K data output terminals each, and that has a control input terminal to receive a display polarity choice signal from a polarity choice source, where the data input terminals in a scan group each receive pixel values in one of said scanned image groups, the number of bits in such a scanned image group having a predetermined polarity is counted, and the look-up table prescribes an ordered set of K bits as an output signal, corresponding to that scanned image group, which determines a pixel value for said displayed image; and a data serializer that has one or more groups of up to K data input terminals each to receive the data output signals from the look-up table, that has at least first and second data output terminals, where the data received at the data serializer input terminals are reformatted into a serial stream of pixel values that issues from a first data output terminal or from a second data output terminal, according as the pixel values belong to said first field or to said second field of pixel values for said displayed image.

5. Apparatus according to claim 3, wherein said memory means is comprised of non-volatile memory elements.

6. Apparatus according to claim 3, further comprising timing means for producing a plurality of timing control signals that control the rate at which said output signals issue from said transformation means and control the rate at which said determined pixel values are displayed by said display means.

7. Apparatus according to claim 6, wherein said memory means is comprised of volatile memory elements and said timing means produces a row/column refresh control signal that determines row and column addresses of storage locations in said memory means that are to be refreshed.

8. Apparatus according to claim 1, wherein said integer $J=4$, said integer $K=2$.

9. Apparatus according to claim 3, wherein said memory means comprises:

first and second memory arrays, each containing storage locations for pixel values, each array having a plurality of bi-directional data input terminals to receive said lines of image data from said source, and each array having a plurality of data output terminals to issue the contents of selected storage locations as memory output signals, where said first memory array receives odd-numbered lines of scanned data and stores these data in its storage locations and said second memory array receives even-numbered lines of scanned data and stores these data in its storage locations, where said first and second memory arrays have a write enable input terminal to receive a write enable signal that allows the memory arrays to receive said lines of image data and said first and second memory arrays have a read enable input terminal to receive a read enable signal that allows the memory arrays to issue the contents of storage locations as output signals at their respective output terminals, and where each of said first and second memory arrays has an array address input terminal to receive an array address signal that designates selected storage locations in the array to which information bits are to be written from the data input terminals, or from which information bits are to be read and issued as output signals at the data output terminals;

a first multiplexer having four input terminals and having an output terminal that is connected to the array address input terminal of said first and second memory arrays, where a first input terminal and a second input terminal together receive a first portion of a memory address for incoming image data, a third input terminal receives a zero offset signal that indicates the horizontal starting position of the image display raster and receives a supplementary signal that designates one of the first and second memory arrays as recipient or source of image data, and a fourth input terminal receives a line address signal that designates a first portion of the address of a line of storage locations in said designated one of said first and second memory arrays that is to be written to or read from, the multiplexer having two control input terminals to receive first and second control input signals that determine which of the input signals received at the four input terminals of the multiplexer shall be used as an output signal at the first multiplexer output terminal;

a second multiplexer having a first input terminal to receive a second line address of a line of storage locations in said designated one of said first and second memory arrays that is to be written to or read from, having a second input terminal to receive the remainder of the memory address for incoming image data, and having a control input terminal to receive a control input signal that determines which of the input signals received at the two input terminals of the multiplexer shall be issued as an output signal at the second multiplexer output terminal;

a first 2N-to-2 decode logic means, where N is an integer that is at least 2, having a first input terminal to receive the output signal of the second multiplexer, having a second input terminal to receive a chip group select signal for selecting a particular memory chip in the first or second memory array, and having an output terminal to issue a signal that designates one of N groups of memory chips in said designated one of said first and second memory arrays from which image data are to be read or to which image data are to be written; and a second N-to-1 decode logic means having an input terminal to receive the remainder portion of the address of a line of storage locations in said designated one of said first and second memory arrays and having an output terminal to issue an output enable signal designating a selected chip group that is received by each of said first and second memory arrays.

10. A method for providing improved resolution of an image displayed on a screen, the method comprising the steps of:

receiving a plurality of lines of scanned image data, where each such line comprises a sequence of pixel values;

forming mutually exclusive groups of J pixel values from said received image data for J adjacent scanned image pixels, counting the number of pixel values with a selected polarity in each group of J pixel values, and issuing an ordered set of K bits that is determined by this count for each group of J pixel values, where each ordered set of K bits determines a display pixel value for the displayed image, and where J and K are predetermined positive integers with K smaller than J; and displaying the determined pixel values on a screen and, for each displayed pixel value that belongs to a selected subset of pixel values, periodically varying such pixel value between the determined pixel value and a predetermined alternative pixel value.

11. The method of claim 10, further comprising the steps of choosing said integer J as 4, choosing said integer K as 2.

12. A method for providing improved resolution of an image displayed on a screen, the method comprising the steps of:

receiving and storing a plurality of lines of scanned image data in a memory, where each line of image data comprises a sequence of pixel values;

forming scanned image groups of pixel values corresponding to J adjacent pixels on the scanned image in a look-up table from lines of image data received from said memory, counting the number of bits of a selected polarity in each such group, issuing as output signals an ordered set of K bits that is determined by this count that determines the display pixel value for a pixel of a displayed image for each group of J pixel values, where J and K are predetermined positive integers and K is smaller than J;

reformatting in a serializer said ordered sets of K bits for said groups of J pixel values into a pair of serial streams of display pixel values; and forming said pair of serial streams and displaying on the screen an image formed of interlaced first and second fields of display pixel values, and where a displayed pixel value is in a selected subset of pixel values, for periodically varying that pixel value between the determined pixel value and a predetermined alternative pixel value.

13. The method of claim 12, further comprising the steps of choosing said integer J as 4, choosing said integer K as 2, and providing said predetermined alternative pixel value as the zero pixel value.

* * * * *

UNITED STATES PATENT AND TRADEMARK OFFICE

CERTIFICATE OF CORRECTION

PATENT NO. : 5,065,149

DATED : November 12, 1991

INVENTOR(S) : Robert M. Marsh, etal.

It is certified that error appears in the above-identified patent and that said Letters Patent is hereby corrected as shown below:

Title page, item (56):

In the references cited, Other Publications, "BYTER" should read - - BYTE - -.

Column 1, line 23, "one image data are compressed" should read - - the image data are compressed - -.

Column 6, line 54, "requires 8 bits" should read - - requires 18 bits - -.

Column 7, line 38, "by (b1)" should read - - by (b0,b1) - -.

Claim 1, column 9, lines 42-44, the phrase "where each ordered set of K bits that is determined by this count for each group of J pixel values" should be deleted; lines 49-50, "an d displaying" should read - - and displaying - -.

Claim 9, column 11, line 35, "address of" should read - - address signal that designates a remainder portion of the address of - -.

Signed and Sealed this

Twenty-third Day of March, 1993

*Attest:*

STEPHEN G. KUNIN

*Attesting Officer*

*Acting Commissioner of Patents and Trademarks*